United States Patent [19]

Steiner et al.

[11] 4,085,789

[45] Apr. 25, 1978

[54] MODULAR WELDING SCREEN APPARATUS

[75] Inventors: Robert J. Steiner, Highland Park; John Kuzelka, Itasca, both of Ill.

[73] Assignee: Steiner Industries, Inc., Chicago, Ill.

[21] Appl. No.: 708,710

[22] Filed: Jul. 27, 1976

[51] Int. Cl.[2] ..... A47G 5/00

[52] U.S. Cl. ..... 160/135; 160/351; 160/378

[58] Field of Search ..... 160/135, 351, 378, 229 R; 24/16 PB, 30.5 P, 20 EE, 20 R, 206 A

[56] References Cited

U.S. PATENT DOCUMENTS

| | | | |
|---|---|---|---|
| 2,571,382 | 10/1951 | Raven | 160/351 |
| 3,186,047 | 6/1965 | Schwester et al. | 24/16 PB |
| 3,204,689 | 9/1965 | Howell | 160/135 |
| 3,428,108 | 2/1969 | Singer | 160/135 |
| 3,494,405 | 2/1970 | Sandahl et al. | 160/378 |
| 3,583,466 | 6/1971 | Dreyer | 160/351 |
| 3,696,855 | 10/1972 | Kira | 160/135 |
| 3,962,827 | 6/1976 | Chaffee | 160/135 |

FOREIGN PATENT DOCUMENTS

| | | | |
|---|---|---|---|
| 1,313,182 | 11/1962 | France | 160/135 |
| 1,400,407 | 7/1975 | United Kingdom | 160/351 |

*Primary Examiner*—Peter M. Caun
*Attorney, Agent, or Firm*—Alter and Weiss

[57] ABSTRACT

A modular welding screen apparatus for shielding welding work locations. The apparatus is fabricated from a series of easy-to-handle panel sections which incorporate independent welding curtains within their framework respectively. The sections which are constructed of square tubular material, pivot relative to one another through a series of rotatable connections which further permits the separate panel section to be arranged to more effectively seal off the welding work location. Interchangeable parts lend to the invention the ability of constructing an individual apparatus as desired, together with the ability of rotating the securely restrained foot supports relative to the welding shield, as necessary.

11 Claims, 10 Drawing Figures

MODULAR WELDING SCREEN APPARATUS

BACKGROUND OF THE INVENTION

The present invention relates, in general, to barricade-type safety products and more particularly to a modular welding screen apparatus for shielding welding work locations.

A great number of safety problems have been well recognized as being associated with ongoing welding operations. The ever-present hazard of burns and property ignition from the sparks inherent with the welding operation presents one main hazard. However, an equally dangerous hazard is present in the form of ultraviolet rays to unshielded eyes. The ultra-violet rays emanating from the arc developed in the welding operation often is of such an intensity as to burn and possibly permanently damage an unshielded eye glancing at the welding operation from a distance. For these reasons, among others, including the desire to completely enclose a workman with his welding project, welding safety screens have been widely used.

The same welding screens and shield are often utilized to enclose other types of "hazardous" work operations so as to safely and effectively isolate the work operations while protecting passersby and nearby property, in such operations as sanding, grinding, and machining.

While a single, upright rectangular screen or curtain can be used to shield off a welding operation in the manner herein described, it is more the practice to incorporate a series of straight screen or shield sections successively together so as to form one foldable longer chain of two or more panel sections connected back-to-back, or, alternatively, a radiating "star" of panel sections forming separate compartments, all of which radiate from a common center outwardly to form the compartments as desired.

While the use of welding curtains is as old as the welding art itself, the type of welding screen, shield, or curtain, has not changed drastically from those initially used in the art. While earlier welding screen models included the utilization of an asbestos type of material hung from an overhead structure, much like a shower curtain, the development of the welding screen has not found radical departure. For example, the most widely known and used conventional welding screen comprises a substantially rectangular construction of tubular, circular pipe, fitted together with a fiberglass or asbestos content curtain suspended between the horizontal and vertical piping. The plurality of panel sections thus formed are hingedly connected to one another to enable the user to lay out the configuration for the overall welding screen which most adequately fits the particular use or need.

The hinging apparatus most frequently used in such an inter-connected screen is, for the most part, comprised of a double cylindrical sleeve which is shaped around the abutting vertical pipe sections in order to successfully attach the pipe section side of one panel to the successive pipe section side of yet another panel section. Such a construction naturally leaves a small portion of space between abutting frame sections which must be covered to effectively shield the welding or other work operation presenting the hazard. In order to do this, most conventional screen assemblies incorporate a single, unitary curtain which extends from the extreme one side of the first panel section frame, all the way across subsequently connected panel sections to the extreme edge of the last panel section in connection. Because the curtain is of a textile type or material construction, it naturally yields to the pivoting action occurring between successive panel sections to enable folding.

There are, however, several problems often associated with the conventional type of welding screen which can arise.

For example, many of the conventionally utilized welding screen apparatus are difficult, if at all possible, to connect in a radiating "star" configuration, in which three or more of the panel sections radiate from a single point outwardly. Similarly, since most of the conventional welding screen devices utilize one large curtain which extends over several hindedly connected panel section frames, additional problems may be encountered. Among these are the fact that such a single curtain is often more expensive than a plurality of smaller curtains and must be tailor-made to cover the expected number of connected panel sections, thus reducing flexibility in connecting less or more panel sections to those already in use. Similarly, if only a portion of the large welding screen curtain is burnt or damaged, it is often necessary to replace the entire curtain instead of just the section which is damaged. This increases the expense of such a welding screen device.

Additionally, with a device having a curtain extending over several panel sections, folding at the hinged locations between panel sections tend to place additional unnecesary wear on those portions of the curtains immediately covering the hinged connections, which could lead to ripping or tearing of the curtain at the hinged location, and the subsequent hazards created by openings in the curtain. Further, the manner in which conventional curtains are restrained within the framework of the panel section, calls for the vast majority of the curtain's weight to be supported by the top horizontal bar of the panel section, placing most of the stress on that bar, while the rest of the framework maintains the curtain in a relatively loose manner.

The conventional panel section construction is often hard to disassemble and break down because of the welded hinging which makes difficult reduction of the assembly for purposes of storage and transportation. Additionally, the circular pipe tubular frame assembly is often subjected to bending, sagging and torque deformation, due to the lack of structural support offered by a circular pipe assembly. Similarly, such a circular pipe assembly requires a substantial amount of bending for purposes of fabrication, as well as substantially high costs for the pivoting joint hinges and the labor involved for the required connection of the hinges to the pipe sections. A circular pipe assembly, similarly depends on circular pipe connection apparatus for connecting the platform legs of the device to the frame assembly. When such a circular pipe connection is utilized, problems often arise with the swivelling of the platform legs when accidentally bumped or moved, which could result in the toppling of the entire welding screen.

It is thus an object of the invention to provide a welding screen apparatus which is relatively easy to fabricate, assemble, and disassemble for purposes of fabrication, storage, and transportation, with component parts that fit accurately into one another in a strong, secure manner and with components that are of a more reinforced channel construction which are more resistant to bending, twisting and applied torque.

It is similarly an object of the invention to provide a welding screen apparatus comprising a plurality of panel sections which are pivoted relative to one another through inexpensive hinging devices which provide a minimum of friction for the pivoting operation, which enable the assembly of the panel sections into any type of desired configuration and when enable close abutment of the panel sections so as to require only individual curtain means for each panel section.

Additionally, it is an object to provide a welding screen device which includes platform leg devices which are easy to position as desired to accommodate the pivoting of the panel sections, and which, at the same time, are substantially sturdy to resist accidental movement from a desired position to keep the panel section upright.

Further, it is an object of the invention to provide a welding operation shield which utilizes individual curtains to avoid the high cost of replacing a burnt or damaged comprehensive common curtain, as well as to provide a device wherein the weight of the curtain itself is more appropriately spread to at least three of the frame members of the panel section, to reduce the amount of stress on any single frame member, through the use of a curtain tie which holds up well under welding or other similar work operations.

These and other objects of the invention will become apparent as described in the present disclosure.

SUMMARY OF THE INVENTION

The present invention is a modular welding screen apparatus for shielding welding work locations or other hazardous locations involving the operations of sanding, or grinding, which comprises a plurality of welding screen panel sections. Each of the welding screen panel sections is constructed of a plurality of horizontal and vertical tubular frame means which have a square cross-sectional shape and which are connected in a substantially rectangular arrangement. A plurality of pivot connection means hinge each of the welding frame panel sections together as desired, in either a successive foldable panel-to-panel arrangement, or in the shape of a radiating panel configuration emanating from a single location. These pivot connection means are attached to the panel sections at the tubular frame means which provide means at the top and bottom ends of the panel section for attachment thereto.

The invention further comprises welding curtain means which are positioned between the horizontal and vertical frame means so as to be generally "framed" by these tubular frame means, and thereby provide a protective shield for the welding location.

The invention further comprises, in the preferred embodiment, leg support means which are attached to the bottom ends of one or more of the plurality of welding frame panel sections for the purpose of restraining the welding screen in a generally upright position.

The square-shaped horizontal and vertical tubular frame means, also in the preferred embodiment, comprise a plurality of substantially straight tubular members each having the substantially square cross-sectional shape, as well as a plurality of tubular corner couplings, which also have a substantially square cross-sectional shape. Each of the corner couplings has a vertical portion and a horizontal portion which are slightly larger in dimension than the straight tubular members, and the vertical and horizontal portions of the corner couplings are disposed from one another by substantially 90° so as to form a corner ell. The vertical and horizontal portions of the corner couplings further telescopically receive the ends of the straight tubular members to attach the members to a substantially rectangular arrangement. Dimple means are located inwardly from the ends of the horizontal and vertical portions for the purpose of interfering with the telescopic receipt of these straight tubular members by the corner couplings. In such a manner, the dimple means describe the distance to which these horizontal and vertical tubular members are received by the vertical and horizontal portions of the corner couplings to appropriately form the rectangular arrangement.

The pivot connection means comprise two or more substantially cylindrical shaped pivot barrels having a first and second end. The first end of each of the pivot barrels is securely attached to one side of a rigid connection member in successive arrangements. The pivot connection means further includes means for fixedly restraining the pivot connection means in attachment with the vertical frame means.

The means for attachment of the pivot connection mens to the tubular frame means comprises one or more of the vertical frame means having its square tubular shape exposed at its upper end or lower end. The exposed upper and lower ends provide a square-shaped tubular attachment orifice at the upper and lower ends of the panel section respectively. Each of these attachment orifices telescopically receives the second end of one of the plurality of the pivot barrels, with the remainder of the plurality of pivot barrels being telescopically received by attachment orifices on other equivalently constructed panel sections, to enable pivotal connection of the plurality of welding panel sections at a single connection. Further, the means for fixedly restraining the pivot connection means in attachment with the vertical frame means, comprises a restraining channel in each of the pivot barrels. A plurality of locking apertures are fabricated into the vertical frame means proximate to the upper and lower ends of the vertical frame means and a plurality of channel restraint pins are utilized with each of the restraint pins inserted through each of the locking apertures respectively, to occupy a position in the restraining channel of the pivot barrel to thereby prevent removal of the pivot barrel from the vertical frame means.

Further, the restraining channel in each of the pivot barrels, as well as the locking aperture in the vertical frame means, are positioned so as to maintain the rigid connection member, which is attached to the first end of the pivot barrel, slightly spaced apart from the upper and/or lower ends of the vertical frame means when the channel restraint pin occupies a position in the channel. Such a spacing arrangement thereby separates the vertical frame means end from the connecting member to avoid excess friction during pivoting, and to reduce the chances of pivot hangups between the vertical frame means and the rigid connection member.

Through the utilization of the plurality of pivotally attached panel frame sections which are joined by the pivot barrels and connecting members at the upper and lower ends of vertical frame means, the vertical frame means of the successively attached panel sections are able to be brought into direct abutment with one another to thereby seal all gaps and spaces between the panel sections, so as to avoid the problems arising out of exposure to the ongoing welding operation occurring behind the plurality of panel sections.

In the preferred embodiment of the invention, the leg support means further comprises one or more substantially square-shaped tubular leg members, each of which has a substantially square-shaped coupling member attached thereto. The square-shaped tubular leg members are attached by the coupling members to the bottom ends of the welding frame panel section by a square-shaped leg mounting appendate emanating from the bottom of the welding frame. This mounting appendage telescopically receives the coupling member and also has dimple means to further restrain the leg support means in place. Through such an arrangement, the leg support means are attachable to the appendages in four different positions, each of which is 90° apart from the other, so as to alter the position of the square-shaped tubular leg member as desired, relative to the welding panel section.

The preferred embodiment of the invention further calls for welding curtain means which comprise a plurality of independent curtains. Each of these independent curtains is positioned between the horizontal and vertical frame means on a particular panel section, respectively, so as to be generally framed by these horizontal and vertical frame means on each of the panel sections. Further, the curtain means are attached to the vertical and horizontal frame means on a particular panel section by adjustable metallic curtain ties which are secured around the vertical and horizontal panel frame means and positioned through eyelets in the curtain means. These adjustable curtain ties enable a secure and tight restraint of the welding curtain within the vertical and horizontal frame means and assist in shifting the weight of the curtains to at least three of the four frame members comprising the rectangular arrangement.

DETAILED DESCRIPTION

Figure 1:
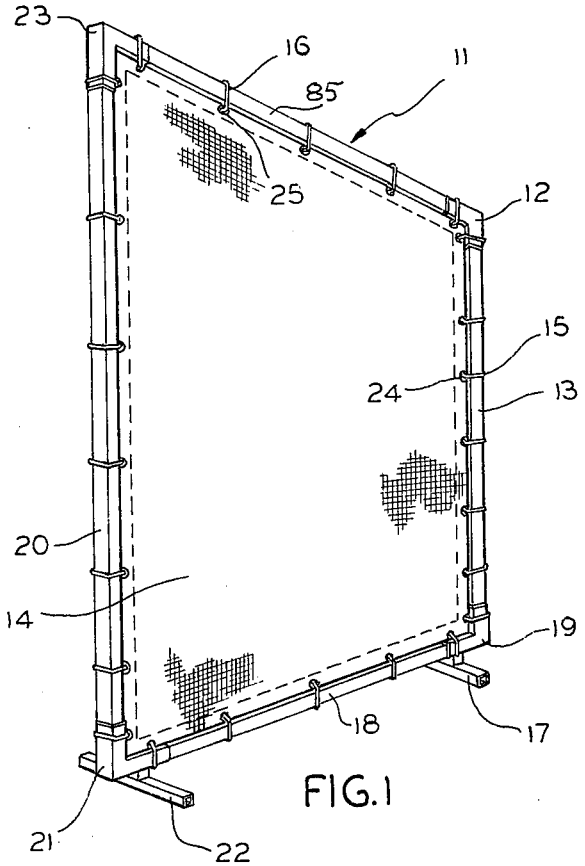
FIG. 1 of the drawings is a side perspective view of the preferred embodiment of the welding screen apparatus, showing, particularly, a typical panel section which in combination with a plurality of other panel sections forms the described invention.

While this invention is susceptible of embodiment in many different forms, there is shown in the drawings and will herein be described in detail, one specific embodiment, with the understanding that the present disclosure is to be considered an exemplification of the principles of the invention and is not intended to limit the invention to the embodiment illustrated.

Welding screen panel section 11 is shown in FIG. 1 comprising vertically disposed tubular members 12 and 20 and horizontally disposed tubular members 18 and 85. The four tubular members in this illustration shape panel section 11 substantially into a rectangle with corner couplings 12, 19, 21 and 23, telescopically receiving these members so as to rigidly secure the rectangular arrangement.

Welding curtain 14 fabricated of appropriate welding shielding material, such as fiberglass or asbestos, is situated between the structural frame members of panel section 11 and rigidly secured thereto. Curtain 14 is restrained in place between the framework of panel section 11 through the use of adjustable curtain ties, such as curtain ties 15 and 16 inserted through eyelets, such as eyelets 24 and 25. Additionally, tubular leg members 17 and 22 are secured to the bottom end of the panel section 11 adjacent to corner couplings 19 and 21 to support panel section 11 in an upright position.

Figure 2:
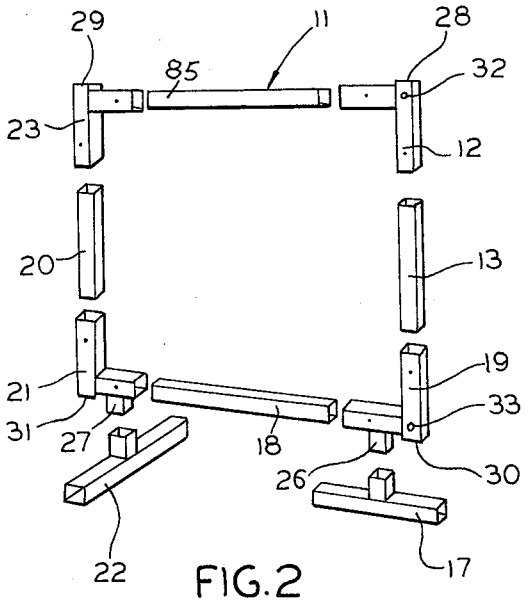
FIG. 2 is a side perspective view showing in exploded form, the components of the individual panel sections of the present invention.

The component frame members of panel section 11 are shown in exploded view in FIG. 2 in which straight tubular members 85, 13, 18 and 20 are restrained in rectangular arrangement between corner couplings 12, 19, 21 and 23. In the preferred embodiment of the invention, the tubular members, such as tubular member 13, is of a square cross-sectional construction which is slightly smaller in dimension than the vertical portions of the corner couplings 12 and 19, so as to be easily but securely received by the vertical portions of corner couplings 12 and 19 for attachment together. Also shown in FIG. 2 are leg mounting appendages 27 and 26, also of square cross-sectional shape, enabling telescopic receipt of the coupling members atop leg members 22 and 17, respectively. As is shown, the square construction of both the appendages and the couplings enable attachment of leg members 22 and 17 in securely restrained positions at 90-degree intervals, to enable placement of leg member 17 substantially parallel to the screen or perpendicular to the screen as shown by leg member 22. Insertion of square appendage 27 into the coupling atop leg member 22, further secures the leg member against accidental rotation of leg member 22 when it is inadvertently struck.

Exposed openings 29, 28, 30 and 31 at the upper and lower ends of corner couplings 23, 12, 19 and 21, respectively, provide attachment orifices for the telescopic insertion of the pivoting connection means. Locking apertures, such as locking apertures 32 and 33, enable the insertion of restraining pins to further secure the pivoting connection means in attachment to the upper and lower ends of the panel section framework. Dimple means such as dimple 86 are also shown and limit the extent to which the corner couplings telescopically receive the tubular members.

Figure 3:
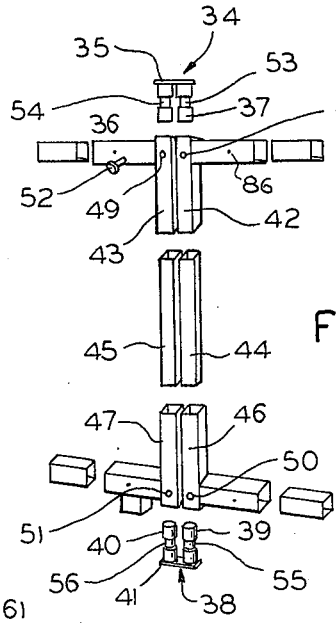
FIG. 3 is a side perspective view of the pivot connection means of the present invention showing, particularly, the connection of the vertical frame means of one panel section to the vertical frame means of the other panel section.
Figure 4:
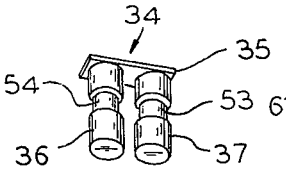
FIGS. 4 through 6 are bottom perspective views of three different configurations of pivot barrel connection devices enabling the attachment of any number of panel sections at a single location, as desired.

Pivot connection means 34 is shown in FIGS. 3 and 4 of the drawings. Pivot connection means 34 comprises rigid connection, member 35, pivot barrels 36 and 37, and restraining channels 54 and 53, respectively. While pivot connection means 34 comprises two such pivot barrels, 36 and 37, it can be seen that even more pivot barrels can be incorporated onto the first side of the rigid connection member so as to enable the attachment of two or more panel sections at a single point from which the panel sections radiate to form separate work compartments. FIG. 3 shows the utilization of pivot connection means 34 to attach the framework of juxtaposed panel sections to one another while permitting pivotal rotation to occur at the point of attachment. In FIG. 3, corner coupling 43, tubular member 45 and corner coupling 47 represent the right side of an individual frame panel section as shown in FIG. 1, while corner coupling 42, tubular member 44, and corner coupling 46 represent the left side of a second juxtaposed and similarly fabricated frame panel section.

Pivot connection means 34 has pivot barrel 36 telescopically received by the attachment orifice provided at the top of corner coupling 49, while pivot barrel 37 is equivalently received by the attachment orifice formed at the top of corner coupling 42. Once the pivot connection means are received by the respective attachment orifices in their respective frame panel sections, channel restraining pins, such as channel restraining pin 52, is inserted and snapped into locking aperture 49 to occupy a space within restraining channel 54, and thereby lock pivot connection means 34 in place within the appropriate corner coupling. Also shown in FIG. 3 are equivalent locking apertures 48, 49, 50 and 51 and pivot connection means 38, comprising rigid connection member 41, pivot barrels 39 and 40, each having restraining channels 55 and 56 respectively.

Figure 5:
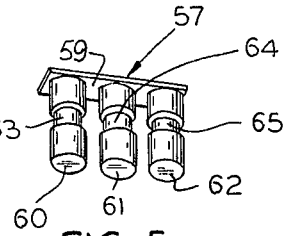
Figure 6:
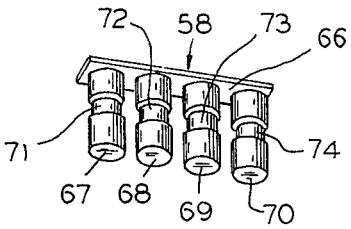

FIGS. 5 and 6 of the drawings illustrate variations of the pivot connection means with FIG. 5 illustrating, particularly, pivot connection means 57 comprising three pivot barrels 60, 61 and 62 for the purpose of attaching three welding frame panel sections together at one location. Rigid connection member 59 is also shown, as are restraining channels 63, 64 and 65 in pivot barrels 60, 61 and 62, respectively.

FIG. 6 shows the equivalent pivot connection means 58, having rigid connection member 66 and four pivot barrels, 67 through 70, with respective restraining channels 71 through 74. This particular connection device enables the pivotal attachment of four panel sections at one location for forming the modular screen welding apparatus.

Figure 7:
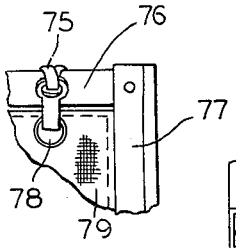
FIG. 7 is a side perspective view of the welding curtain means position juxtaposed the horizontal and vertical frame means through the use of adjustable curtain ties.

FIG. 7 of the drawings shows a portion of the welding screen apparatus, particularly displaying curtain 79 maintained in place within the framework described by the horizontal and vertical tubular frame means. A typical corner coupling is shown comprising horizontal portion 76 and vertical portion 77 surrounding the corner of welding curtain 79. Curtain tie 75 has been inserted through and around eyelet 78 of curtain 79 and thereafter adjusted tightly and folded over so as to securely restrain that portion of curtain 79 in close juxtaposition to corner coupling components 76 and 77.

Figure 8:
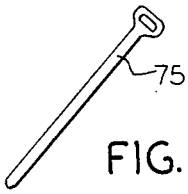
FIG. 8 is a top plan view of the curtain tie utilized in the present invention.

FIG. 8 of the drawing shows in enlargement, curtain tie 75, which enables secure and adjustable restraint of the curtain along the majority of frame means. Further, in the preferred embodiment, curtain tie 75, is of a pliable, metallic construction for purposes of durability during a welding operation, as well as for purposes of re-use after replacement of the curtain, for example.

It has been previously mentioned that most conventional welding screen devices incorporate a long welding curtain for purposes of extending across separate panel sections so as to cover gaps and spaces between the welding frame sections themselves. The present invention is able to utilize independent welding screens within each welding frame panel section, because of its ability to bring the sides of vertical frame means of the attached welding frame sections into close abutment.

Figure 9:
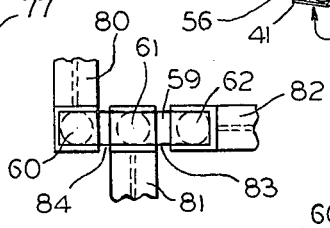
FIG. 9 is a top plan view illustrating pivotal connection of three particular panel sections, utilizing the pivot connection device of FIG. 5.
Figure 10:
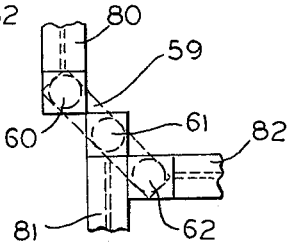
FIG. 10 is a view of the pivotal connection shown in FIG. 9 in which the panel sections have been further pivoted to abut one another to substantially close gaps and spaces between the panel sections.

FIGS. 9 and 10 illustrate the structural features of the present invention. In FIG. 9 panel sections 80, 81 and 82 have been pivotally attached by pivot connection means comprising rigid connection member 59 and pivot barrel 60 through 62. As is readily apparent, spaces 84 and 83 would occur between the panel sections to the detriment of the user, since sparks from the welding operation, as well as a view of the welding arc itself could penetrate the welding screen apparatus. However, with the pivotal construction provided by the pivot connection means and the attachment orifices on the frame means of the present device, the panel section configuration is slightly altered to that of FIG. 10, wherein panel sections 80, 81 and 82 abut one another in succession to effectively close off and seal such undesirable gaps and spaces.

The foregoing description and drawings merely explain and illustrate the invention and the invention is not limited thereto, except insofar as the appended claims are so limited, as those skilled in the art have the disclosure before them will be able to make modifications and variations therein, without departing from the scope of the invention.

What is claimed is:

1. A modular welding screen apparatus for shielding welding work locations comprising:

a plurality of welding frame panel sections, each of said welding frame panel sections constructed of a plurality of substantially square-shaped horizontal and vertical tubular frame means connected in a substantially rectangular arrangement;

a plurality of interchangeable pivot connection means capable of alternative attachment and removal from said panel sections in a facilitated manner, said plurality of pivot connection means pivotally hinging three or more of said plurality of welding frame panel sections together as desired for substantially free pivotal movement therebetween, one or more of said tubular frame means providing means along the top and bottom ends of said panel section for attachment thereto of said pivot connection means;

each of said pivot connection means including a rigid connecting member directly spanning the distance between said respective ends of said respectively connected panel sections; and substantially flexible welding curtain means positioned between said horizontal and vertical tubular frame means so as to be generally framed by said horizontal and vertical frame means, thereby providing a protective shield for said welding work location.

2. The invention according to claim 1 in which said modular welding screen further comprises leg support means attached to the bottom of one or more of said plurality of welding frame panel sections for restraining said welding screen in a generally upright position;

said leg support means comprising one or more substantially square-shaped tubular leg members each having a substantially square-shaped coupling member attached thereto, each said square-shaped tubular leg member attached by said coupling member to said bottom end of said welding frame panel section by a square-shaped leg mounting appendage emanating from the bottom of said welding frame, said mounting appendage telescopically receiving said coupling member and having dimple means to further restrain said leg support means in place, and said leg support means attachable to said appendages at four different positions through 90 degree intervals so as to alter the positions of said square-shaped tubular leg member relative to said welding panel section.

3. The invention according to claim 1 in which said square-shaped horizontal and vertical tubular frame means comprise:

a plurality of substantially straight tubular members, each having a substantially square cross-sectional shape; and a plurality of tubular corner couplings each having a substantially square cross-sectional shape, each of said plurality corner couplings having a vertical portion and a horizontal portion which are slightly larger in dimension than said straight tubular members, said vertical and horizontal portions of each said corner coupling disposed from one another by substantially 90°, said vertical and horizontal portions of said corner couplings telescopically receiving the ends of said straight tubular members to attach said members into said substantially rectangular arrangement.

4. The invention according to claim 3 in which said corner couplings further comprise dimple means located inwardly from the ends of said horizontal and vertical portions, said dimple means interfering with the telescopic receipt of said straight tubular members by said corner coupling and described the distance to which said members are received by said vertical and horizontal portions to form said rectangular arrangement.

5. The invention according to claim 1 in which each of said plurality of pivot connection means comprises:

two or more substantially cylindrical shaped pivot barrels, each of said cylindrical pivot barrels having a first and second end, said first end of each said pivot barrel securely attached to one side of said rigid connecting member in successive arrangement, and means for fixedly and positively attaching said pivot connection means to said vertical frame means to preclude inadvertent removal therefrom.

6. The invention according to claim 1 in which said welding curtain means comprises a plurality of independent curtains, each said independent curtain being positioned between said horizontal and vertical frame means of each of said welding panel section respectively so as to be generally frame by said horizontal and vertical frame means of each of said plurality of said panel sections respectively.

7. The invention according to claim 1 in which said curtain means is attached to said vertical and horizontal frame means in said rectangular arrangement by adjustable metallic curtain ties which are manually tightened to a fixed length and which are secured around said vertical and horizontal frame means and positioned through eyelets in said curtain means.

8. The invention according to claim 1 in which each of said plurality of pivot connection means comprises:

one or more substantially cylindrical shaped pivot barrels, each of said cylindrical pivot barrels having a first and second end, said first end of each said pivot barrel securely attached to one side of said rigid connecting member, said second end of said pivot barrel attached into said tubular frame means of a first of said plurality of welding frame panel sections, said rigid connecting member having one or more pivot connection devices at its second end, said one or more pivot connection devices attached to the tubular frame means of a second of said plurality of welding frame panel sections thereby providing substantially free pivotal movement between said first and second welding frame panel sections.

9. A modular welding screen apparatus for shielding welding work locations comprising:

a plurality of welding frame panel sections, each of said welding frame panel sections constructed of a plurality of substantially square-shaped horizontal and vertical tubular frame means connected in a substantially rectangular arrangement;

a plurality of pivot connection means for pivotally hinging each of said plurality of welding frame panel sections together as desired, each of said plurality of pivot connection means comprising two or more substantially cylindrical shaped pivot barrels, each of said cylindrical pivot barrels having a first and second end, said first end of each said pivot barrel securely attached to one side of a rigid connecting member in successive arrangement.

means for fixedly restraining said pivot connection means in said attachment with said vertical frame means comprising one or more of said vertical frame means having its square tubular shape exposed at its upper and lower ends, each said exposed upper and lower end providing a square-shaped tubular attachment orifice at said upper and lower ends of said panel section respectively, each said attachment orifice telescopically receiving said second end of one of said plurality of pivot barrels, and said remainder of said plurality of pivot barrels being telescopically received by attachment orifices on other equivalently constructed panel sections so as to pivotally connect said plurality of welding panel sections at a single location;

one or more of said tubular frame means providing means at the top and bottom ends of said panel section for attachment thereto of said pivot connection means; and welding curtain means positioned between said horizontal and vertical tubular frame means so as to be generally framed by said horizontal and vertical frame means, thereby providing a protective shield for said welding work location.

10. The invention according to claim 9 in which said means for fixedly restraining said pivot connection means in said attachment with said vertical frame means comprises:

a restraining channel in each of said pivot barrel;

a plurality of locking apertures in said vertical frame means proximate to said upper and lower ends of said vertical frame means, and a plurality of channel restraint pins, each of which is inserted through each of said locking apertures respectively to occupy a position in said restraining channel of said pivot barrel to thereby prevent removal of said pivot barrel from said vertical frame means, said restraining channel in each said pivot barrel and said locking aperture being positioned so as to maintain said rigid connection member in attachment to said first end of said pivot barrel slightly spaced apart from the upper and lower ends of said vertical frame mens when said channel restraint pin occupies a position in said channel, thereby separating said vertical frame means ends from said connecting member and avoiding excess friction and pivot hangups between said vertical frame means and said rigid connection member.

11. The invention according to claim 9 in which said plurality of pivotally attached panel frame sections is joined at the upper and lower ends of said vertical frame means so as to enable abutment of said vertical frame members in succession, thereby avoiding gaps and spaces between said panel sections and the disadvantages such gaps and spaces impart to a welding shield apparatus.

* * * * *

UNITED STATES PATENT AND TRADEMARK OFFICE

CERTIFICATE OF CORRECTION

PATENT NO. : 4,085,789
DATED : April 25, 1978
INVENTOR(S) : Robert J. Steiner and John Kuzelka It is certified that error appears in the above-identified patent and that said Letters Patent are hereby corrected as shown below:

| | |
|---|---|
| Col. 2, Line 16 | After "several" delete "hindedly" and insert instead --hingedly--. |
| Col. 3, Line 9 | After "and" delete "when" and insert instead --which--. |
| Col. 4, Line 25 | Before "to the" delete "mens" and insert instead --means--. |
| Col. 9, Line 39 | After "corner" delete "coupling" and insert instead --couplings--, after "and" delete "described" and insert instead --describing--. |
| Col. 12, Line 2 | After "frame" delete "mens" and insert instead --means--. |

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*